US007745728B2

(12) United States Patent
Fisher et al.

(10) Patent No.: US 7,745,728 B2
(45) **Date of Patent: *Jun. 29, 2010**

(54) FAULT PROTECTED ELECTRICAL CABLE

(75) Inventors: Barry Fisher, Marion, IN (US); Gregg Szylakowski, Bargersville, IN (US); Mark Easter, Indianapolis, IN (US)

(73) Assignee: General CableTechnologies Corporation, Highland Heights, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/277,962

(22) Filed: Nov. 25, 2008

(65) Prior Publication Data

US 2009/0071685 A1 Mar. 19, 2009

Related U.S. Application Data

(63) Continuation of application No. 11/250,626, filed on Oct. 17, 2005, now Pat. No. 7,501,577.

(51) Int. Cl.
*H01B 1/00* (2006.01)

(52) U.S. Cl. ..... 174/102 SC; 174/113 R

(58) Field of Classification Search ..... 174/102 SC, 174/113 R

See application file for complete search history.

(56) References Cited

U.S. PATENT DOCUMENTS 2,446,387 A 8/1948 Peterson
3,297,814 A 1/1967 Mcclean
3,474,189 A 10/1969 Arnaudin et al.
3,571,613 A 3/1971 Plate et al.
3,660,592 A 5/1972 Anderson
3,705,257 A 12/1972 Wade
3,737,557 A 6/1973 Verne et al.
3,794,752 A 2/1974 Bunish et al.
4,002,820 A 1/1977 Paniri et al.
4,143,238 A 3/1979 Sheth
4,313,029 A 1/1982 Bunish
4,424,403 A 1/1984 Bogese, II
4,469,539 A 9/1984 Wade et al.
5,451,718 A 9/1995 Dixon
6,486,395 B1 * 11/2002 Temblador ..... 174/36
7,501,577 B2 * 3/2009 Fisher et al. ..... 174/102 SC
2002/0081429 A1 6/2002 Gustafsson et al.

* cited by examiner

*Primary Examiner*—Chau N Nguyen
(74) *Attorney, Agent, or Firm*—Blank Rome LLP

(57) ABSTRACT

A low-voltage electrical power cable that includes of at least one uninsulated ground conductor and at least one insulated power conductor. The ground conductor and the power conductor are covered with an electrically conductive composition such that the power conductor contacts the electrical conductive composition for improving the flow of a fault current to the ground conductor and to trigger a circuit breaker when the low-voltage power cable is damaged by generating the fault current without the presence of a ground check wire.

28 Claims, 1 Drawing Sheet

FAULT PROTECTED ELECTRICAL CABLE

This application is a continuation of U.S. patent application Ser. No. 11/250,626, filed Oct. 17, 2005 which claims priority under 35 U.S.C. 119(e) based upon U.S. Provisional Patent Application No. 60/618,587, filed Oct. 15, 2004, both are which incorporated herein in their entirety.

FIELD OF THE INVENTION

An improved fault protected electric power cable is disclosed. In the improved fault protected electric power cable, there are at least two insulated power conductors and an uninsulated ground conductor wherein the ground conductor and the insulated power conductors are all in electrical contact with a conductive polymer composition. If an electrical fault occurs in one of the power conductors the conductive polymer composition will carry the current to the ground conductor.

BACKGROUND OF THE INVENTION

Multi conductor power cables, also known as portable cables, are known. Although this is not an exhaustive listing of their applications, they are used extensively in mining operations for power excavating, drilling and transporting equipment both in the mine and on the surface. They are typically coiled on and off a reel as the machine moves. Such reels are generally described in U.S. Pat. No. 4,664,331. Other uses for such portable cables are for cranes and other heavy equipment on docks and construction sites and also as temporary power cables used by utility companies and others. During use, these cables are dragged across the ground, roadways, tracks and other obstacles and subject to damage.

If a multi conductor power cable is damaged, this may result in electrical faults that could cause fire, arcing and explosion of combustible gasses and injury to persons by burning or electrical shock.

Commonly assigned U.S. Pat. No. 6,402,993 discloses a cable construction suitable for higher voltages of about 15 Ky. This patent is illustrative of a basic construction wherein a conductor is shielded with a semi-conductive polymer compositions or possibly conductive tape, then also wrapped with copper wire, copper braid or metal tape. The conductive polymer composition in this case equalizes the electrical stresses that would occur under each wire and prevents an electrical discharge at the overlaps of the tape. At higher voltages the fault current jumps directly to the copper tapes or wires. Cables may also have semi conductive water blocking layers as in U.S. Pat. No. 6,455,769.

Shielded lower voltage cables are also known where braided copper or aluminum wires or copper tapes are placed over the power and ground conductors. These constructions have several disadvantages in that they are much more expensive to produce, are less flexible and tend to have a shorter life if flexed as the braid breaks or cuts into the insulation of the conductor. They have a larger cross section and are heavier so less length can be put on a reel and are also harder to terminate.

Lower voltage cables may or may not have a designated ground conductor or an uninsulated ground conductor.

Ground check cables are known. A ground-check conductor is an insulated conductor which is used to "check" the grounding conductor. Approximately one ampere of current is sent down the ground check. The GC is mechanically tied in to the frame of the machine as is the grounding conductor.

A simple series circuit is formed and if either the ground or the ground check is broken, the circuit is incomplete and the circuit breaker in the power center will trip.

There are constructions wherein shields on shielded cables carry the fault current to the ground conductor. Typically a relay or monitoring circuit interrupts the voltage to the cable which is then repaired or replaced. U.S. Pat. No. 6,801,117 discloses a cable with thermal and damage sensor wires. Damage is sensed when the sensor wire is broken. A disadvantage of this construction is that a sensor wire could break while the conductor is not exposed. Also, a complicated circuit is required to monitor the sensors and a signal must be sent from the other end of the wire to the monitoring circuit for it to detect an interruption. U.S. Pat. No. 4,785,163 discloses an ungrounded heating cable where two polymer composition layers are separated by an insulation. If contact is made between the two layers damage is sensed. U.S. Pat. No. 6,784,371 discloses a cable with sensing wires to detect a substance inside the cable. Other cables are known with temperature and moisture sensors. In all these cables a signal is generated that must be processed and a determination made to shut off the cable.

Other solutions to the problem of cable damage have been proposed such as so called "self healing" cables wherein a polymer composition seals and repairs damage in a cable. See, for example, U.S. Pat. Nos. 6,184,473 and 5,313,020.

Ground fault current interrupters are known that can detect small currents leaking to ground. In many applications ground fault current interrupters are set at a high level to avoid false trips due to moisture in the insulation conducting small currents or one or more areas of small damage that are difficult to find and fix but would otherwise trip the circuit breaker.

SUMMARY OF THE INVENTION

The invention provides a low cost, flexible, lightweight cable that performs as well as an expensive shielded cable to prevent damage or injury due to faults. The invention also provides a cable that will positively shut off in the event of a fault without risk of personal injury.

The invention provides a fault protected cable with one layer of a conductive polymer composition, or in other embodiments of the invention, at least one layer of a conductive polymer composition.

In embodiments of the invention, an electrical cable according to the invention comprises at least one uninsulated ground conductor and at least one insulated power conductor wherein said ground conductor is covered with an electrically conductive composition for improving the flow of a fault current to said ground conductor. In embodiments of the invention, the electrically conductive composition is a conductive polymer. In other embodiments of the invention, the electrically conductive composition is a semi-conductive polymer.

In embodiments of the invention, an electrically conductive composition according to the invention has properties wherein said electrically conductive composition is a polymer having a volume resistivity, measured according to ASTM D 991, of no more than $10^9$ ohm/cm. In other embodiments of the invention, an electrically conductive composition according to the invention has properties wherein said electrically conductive composition is a polymer having a volume resistivity, measured according to ASTM D 991, of no more than $10^6$ ohm/cm. In other embodiments of the invention, an electrically conductive composition according to the invention has properties wherein said electrically conductive composition is a polymer having a volume resistivity, measured according to ASTM D 991, of no more than $10^3$ ohm/cm.

In embodiments of the invention, an electrically conductive composition according to the invention may partially surround the uninsulated ground conductor or may completely surround the uninsulated ground conductor. In embodiments of the invention, an electrically conductive composition according to the invention may partially surround the at least two insulated power conductors or may completely surround the at least two insulated power conductors.

DETAILED DESCRIPTION OF THE INVENTION

Figure 1:
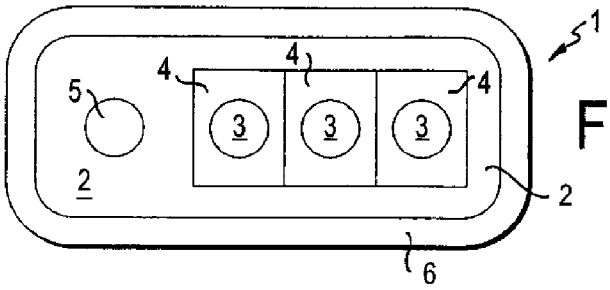
FIG. 1 shows a cross-section of a cable according to the invention.
Figure 2:
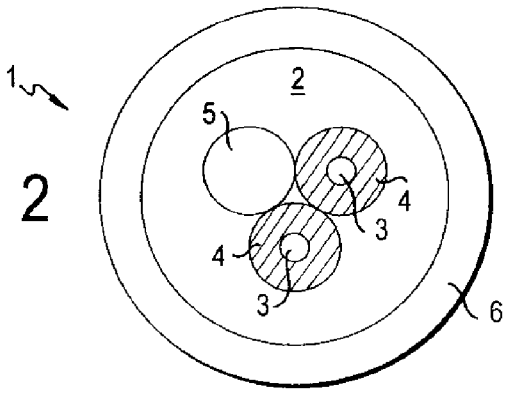
FIG. 2 shows a cross-section of another embodiment of a cable according to the invention.
Figure 3:
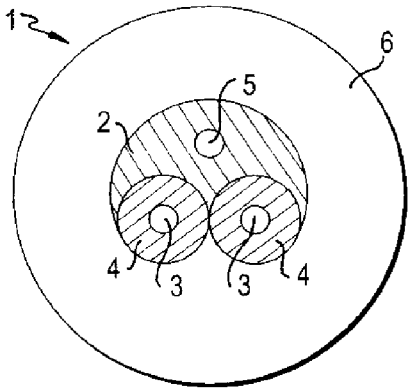
FIG. 3 shows a cross-section of another embodiment of a cable according to the invention.
Figure 4:
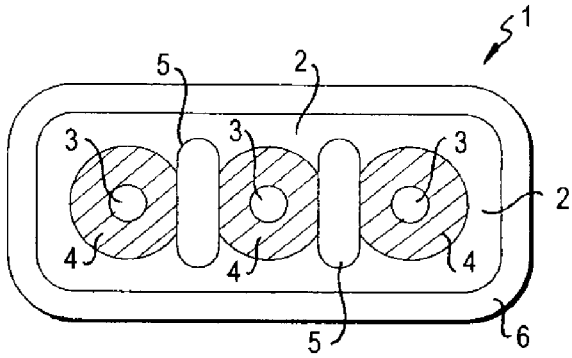
FIG. 4 shows a cross-section of another embodiment of a cable according to the invention.

In every Figure, power cable 1 comprises at least two power conductor core wires 3 surrounded by insulation 4, thereby forming insulated power conductors. At least one of the insulated power conductors is adjacent to an uninsulated ground conductor 5. FIG. 4 shows an embodiment with two uninsulated ground conductors 5 each located between two of the insulated power conductors. In every embodiment shown in FIGS. 1-4, the insulated power conductors and the uninsulated ground conductor(s) all are surrounded by electrically conductive composition 2, which is in turn further surrounded by optional jacket 6. The jacket 6 maybe substantially flat (FIGS. 1 and 4), with at least one substantially flat surface, or substantially round (FIGS. 2 and 3.) In every instance the electrically conductive composition 2 forms an electrically conducting path between the uninsulated ground conductor 5 and every insulated power conductor. The power conductors may be substantially the same size in cross-section as the ground conductor, as seen in FIG. 1 for example.

FIG. 3 shows a cable where the electrically conductive composition 2 completely surrounds the uninsulated ground wire and is in positive contact with the insulated power conductors, but does not completely surround the two insulated power conductors. In FIG. 4, the electrically conductive composition 2 does not completely surround the uninsulated ground wires 5 and does not completely surround the two insulated power conductors either.

The power cables of the invention may be flat, round, oval or irregularly shaped in cross sectional shape. The power cable in accordance with the invention has at least two insulated power conductor(s) wherein the uninsulated ground conductor is fully or partially surrounded by electrically conductive composition 2 which also fully or partially surrounds and is thus in contact with the insulated power conductor(s).

In embodiments of the invention, electrically conductive composition 2 may be a conductive polymer composition or a semi-conductive polymer compositions.

In the manufacture, use and design of power conducting electrical cable, these compositions are typically used to equalize electrical stress fields as described in published U.S. patent application 2003/0111253A1 or to mitigate static electric discharge in thin layers. They have heretofore not been used for the function of the invention described herein, that is to actually conduct electric current from a an electric fault in a conductor to the ground conductor in order to be safely discharged. Surprisingly, in the appropriate thickness and with sufficiently low resistivity they can carry enough current to achieve the purpose of the invention.

The conductor(s) can be any size copper or aluminum wire or stranded wire necessary to carry the required current. There may be multiple insulated power and ground conductors. There may be multiple uninsulated ground conductors.

The insulation for the conductors may be, for example, polyethylene, EPR or EPDM, silicon or other alpha olefins, insulation compositions known in the art or other insulating polymers, or silicon or mica tapes. In particular, EI4728A from General Cable Corporation or 3728A from Electric Cable Compounds EPDM rubber insulations or HFDB 4202 polyethylene insulation, for example, may be used.

The polymer material which constitutes the base polymer of the electrically conductive composition 2 can be any type of polymer suitable to meet the necessary electrical volume resistivity properties described herein and to accept, optionally, fillers and/or additives to that end. Accordingly, the polymer material selected for the base polymer of the electrically conductive composition 2 can be any of the following types of polymer and is selected from the group consisting of: polyolefins, copolymers of different olefins, copolymers of an olefin with an ethylenically unsaturated ester, polyesters, polycarbonates, polysulphones, phenol resins, urea resins, and mixtures thereof. Examples of suitable polymers are: polyethylene (PE), in particular low density PE (LDPE), medium density PE (MDPE), high density PE (HDPE), linear low density PE (LLDPE), ultra-low density polyethylene (ULDPE); polypropylene (PP); elastomeric ethylene/propylene copolymers (EPR) or ethylene/propylene/diene terpolymers (EPDM); natural rubber; butyl rubber; ethylene/vinyl ester copolymers, for example ethylene/vinyl acetate (EVA); ethylene/acrylate copolymers, in particular ethylene/methyl acrylate (EMA), ethylene/ethyl acrylate (EEA) and ethylene/butyl acrylate (EBA); ethylene/alpha-olefin thermoplastic copolymers; polystyrene; acrylonitrile/butadiene/styrene (ABS) resins; halogenated polymers, in particular polyvinyl chloride (PVC); polyurethane (PUR); polyamides; aromatic polyesters such as polyethylene terephthalate (PET) or polybutylene terephthalate (PBT); polybutene; polyisobutylene; polyaniline; and copolymers thereof or mechanical mixtures thereof.

The additives to the base polymer material of the electrically conductive composition 2 can be any type of additive suitable to meet the necessary electrical volume resistivity properties described herein. Carbon black, carbon fibers, carbon nanotubes, graphite, conductive polymers powders such as polyaniline, metal powders, any conductive flakes, fibers or strands such as copper, steel, silver or combinations of these. For example, in order of conductivity enhancement from least to greatest, carbon black is less conductive than carbon fiber, then graphite, then conductive polymer and finally metals are more conductive. Further illustrating this principle, for example about 20% by weight of a furnace carbon black would be required for $10^9$ ohm/cm resistivity and about 35% for a value of $10^3$. In contrast, only 5%-10% added metal powder would achieve below $10^3$ ohm cm resistivity. If desirable and/or if more current needs to be conducted metal powders or fibers or metal coated fibers or the like can be used alone or in combination with carbon black in the electrically conductive composition 2. The electrically conductive composition 2 can be mixed by Banbury, or twin screw extruders or other mixers known in the art by methods well known in the art.

The electrically conductive composition 2 is preferably a carbon black filled polyolefin polymer conductive polymer compositions as described in U.S. Pat. No. 5,556,697 or U.S. published patent application 2003/0111253A1, the disclosures of which are incorporated herein by reference.

Also suitable as the electrically conductive composition 2 are compositions such as are disclosed in U.S. Pat. Nos. 4,095,039 and 4,703,132, with or without particles of water swellable material, U.S. Pat. Nos. 6,210,607B1, and 6,221,283B1, published PCT applications WO 2004083332 and WO 2004083292 as well are suitable for use in the invention and the disclosures of which are incorporated herein by reference. A Compound commercially available from The Dow chemical Co. designated as HFDA 0581 is suitable for use in the invention as the electrically conductive composition.

The electrically conductive composition 2 in accordance with the invention should have a volume resistivity, when measured according to ASTM D 991, of no more than $10^9$ ohm/cm, preferably no more than $10^6$ ohm CM and most preferably less than $10^3$ ohm CM. Most conductive polymer compositions do not have resistivity below 1 ohm cm, whereas metals have resistivity of below 0.1 ohm cm. Materials with resistivity above $10^9$ ohm cm are considered insulators.

The electrically conductive composition 2 in accordance with the invention may be cross linked with organic peroxides, sulfur compounds, hydrolysable silane or the like or not cross linked. They can be cross linked in one step with the conductor insulation and jacket, if included, or not cross linked.

The electrically conductive composition 2 may or may not contain halogenated or mineral or chemical flame retardants.

The electrically conductive composition 2 layer over the ground conductor and optionally encircling the power conductor(s) may be anywhere from 1 to 15 mm thick at its thinnest point. It should be understood it may be thicker in the valley between to conductors. Preferably it will be 1 to 10 mm thick and most preferably 1 to 5 mm thick. Below about 1 mm it will not have the current carrying capacity and above about 5 mm is not necessary to carry the current and adds cost, weight and cross section to the cable. The more conductive the conductive polymer composition is, the thinner the layer required.

The electrically conductive composition 2 may serve as the outside layer of the cable or a jacket may be extruded over it. The jacket may be desired for extra toughness or flame resistance. The jacket may be a polyolefin, CPE, CsPE, PVC or other polymer and optionally may be cross linked.

The cable is typically constructed by individually extruding insulation over each power conductor with a crosshead die as is well know in the art. The insulation may be cured during this step or after assembly into the cable. The power conductors may be collected with the neutral and bound together with a string or braid of string. The electrically conductive composition 2 may be extruded over all or part of the collected conductors in a crosshead die or pumped on if it is a hot melt composition. The electrically conductive composition 2 and optionally the power conductor insulations may be cured at this point or may be cured with the jacket, if desired. Other fillers or sealants may be added to fill gaps or valleys in the construction, such as exists between the conductors and the ground wire in the central portion of the cable shown in FIG. 2. Optionally a jacket is extruded over the entire assembly. Optionally the jacket and or the whole cable may be cured with heat, steam, a melted salt bath, hot lead or irradiation. One may consult ICEA S 75 381 for additional specifications on construction of these types of cables as well.

A method is disclosed for testing the effectiveness of the electrically conductive composition 2 containing cable of the invention. The desired length of cable is connected on the intended equipment or in a lab. A six penny nail or similar damage causing object is driven through the cable into the power conductor farthest from the ground conductor. A circuit breaker or ground fault interrupter with the desired amperage rating is installed on the ground conductor. The cable is then connected to the power source and energized and the breaker or interrupter shuts off the circuit if the conductive polymer composition is of sufficient thickness and low enough resistance.

The description above should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A low-voltage electrical power cable comprising of:

at least one uninsulated ground conductor and at least one power conductor, said at least one power conductor being substantially the same size in cross-section as said at least one ground conductor, wherein said ground conductor and said power conductor are covered with an electrically conductive composition such that at least said power conductor contacts said electrical conductive composition for improving the flow of a fault current to said ground conductor and to trigger a circuit breaker when the low-voltage power cable is damaged by generating said fault current without the presence of a ground check wire.

2. A low-voltage electrical cable in accordance with claim 1 wherein said electrically conductive composition is a conductive polymer.

3. A low-voltage electrical cable in accordance with claim 1 wherein said electrically conductive composition is a semi-conductive polymer.

4. A low-voltage electrical cable in accordance with claim 1 wherein said electrically conductive composition is a polymer having a volume resistivity, measured according to ASTM D 991, of no more than $10^2$ ohm/cm.

5. A low-voltage electrical cable in accordance with claim 1 wherein said electrically conductive composition is a polymer having a volume resistivity, measured according to ASTM D 991, of no more than $10^3$ ohm/cm.

6. A low-voltage electrical cable in accordance with claim 1 wherein a cross sectional thickness of said electrically conductive composition less than about 15 mm at a thinnest point.

7. A low-voltage electrical cable according to claim 1 further comprising:

a jacket substantially enclosing said at least one uninsulated ground conductor, said at least one power conductor, and said electrically conductive composition.

8. A low-voltage electrical power cable according to claim 7, wherein said jacket has at least one substantially flat surface.

9. A low-voltage electrical power cable comprising:

at least one uninsulated ground conductor;

at least two low-voltage power conductors, at least one of said power conductors being substantially the same size in cross-section as said at least one ground conductor; and an electrically conductive composition in contact with said ground conductor and said at least two power conductors providing a path for a fault current to said ground conductor and wherein said ground conductor is substantially completely surrounded by said electrically conductive composition in order to trigger a circuit breaker when the cable is damaged by generating said fault current without the presence of a ground check wire.

10. A low-voltage electrical cable in accordance with claim 9 wherein said ground conductor is completely surrounded by said electrically conductive composition.

11. A low-voltage electrical cable in accordance with claim 9 wherein said at least two power conductors are completely surrounded by said electrically conductive composition.

12. A low-voltage electrical cable in accordance with claim 9 wherein said electrically conductive composition is a conductive polymer.

13. A low-voltage electrical cable in accordance with claim 9 wherein said electrically conductive composition is a semi-conductive polymer.

14. A low-voltage electrical cable in accordance with claim 9 wherein said electrically conductive composition is a polymer having a volume resistivity, measured according to ASTM D 991, of no more than 500 ohm/cm.

15. A low-voltage electrical cable in accordance with claim 9 wherein a cross sectional thickness of said electrically conductive composition is less than about 15 mm at a thinnest point.

16. A low-voltage electrical cable according to claim 9 further comprising a jacket substantially enclosing said at least one uninsulated ground conductor, said at least two power conductors, and said electrically conductive composition.

17. A low-voltage electrical power cable according to claim 16, wherein said jacket has at least one substantially flat surface.

18. A low-voltage electrical cable according to claim 9 wherein said at least one uninsulated ground conductor being embedded in said electrically conductive composition.

19. A low-voltage electrical power cable, comprising of:

an electrically conductive composition;

at least one uninsulated ground conductor substantially embedded in said electrically conductive composition; and at least two low-voltage power conductors in contact with said electrically conductive composition, said at least one of said power conductors being substantially the same size in cross-section as said at least one ground conductor, thereby defining an electrically conducting path between said uninsulated ground conductor and said at least two insulated power conductors facilitating the flow of a fault current to said uninsulated ground conductor.

20. A low-voltage electrical cable according to claim 19, wherein said electrically conductive composition covers all surfaces of said at least one uninsulated ground wire.

21. A low-voltage electrical cable according to claim 19, wherein said at least two power conductors are substantially embedded in said electrically conductive composition.

22. A low-voltage electrical cable according to claim 19, further comprising a second uninsulated ground conductor embedded in said electrically conductive material.

23. A low-voltage electrical cable according to claim 19, further comprising a jacket substantially surrounding said at least one uninsulated ground conductor, said at least two power conductors, and said electrically conductive composition.

24. A low-voltage electrical power cable according to claim 23, wherein said jacket has at least one substantially flat surface.

25. A low-voltage electrical power cable, comprising:

at least one ground conductor;

at least one low-voltage power conductor;

an electrically conductive composition in contact with said at least one ground conductor and said at least one power conductor providing a path for a fault current to said ground conductor in order to trigger a circuit breaker when the cable is damaged by generating said fault current without the presence of a ground check wire wherein said ground conductor and said power conductor are embedded in said electrically conductive composition; and a jacket substantially enclosing said ground conductor, said power conductor, and said electrically conductive composition, said jacket having at least one substantially flat surface.

26. A low-voltage power cable according to claim 25, wherein said ground conductor is substantially the same size in cross-section as said power conductor.

27. A low-voltage power cable according to claim 25, wherein said jacket is substantially flat.

28. A low-voltage power cable according to claim 25, wherein said ground conductor has a different cross-sectional shape than said power conductor.

* * * * *